US008418326B2

(12) United States Patent
Kozato et al.

(10) Patent No.: US 8,418,326 B2
(45) Date of Patent: Apr. 16, 2013

(54) METALLIC ONE-SIDE TEETH AND TWO-WAY SLIDE FASTENER

(75) Inventors: Futoshi Kozato, Toyama (JP); Hayato Ishii, Toyama (JP)

(73) Assignee: YKK Corporation (JP)

( * ) Notice: Subject to any disclaimer, the term of this patent is extended or adjusted under 35 U.S.C. 154(b) by 296 days.

(21) Appl. No.: 12/934,266

(22) PCT Filed: Apr. 14, 2008

(86) PCT No.: PCT/JP2008/057303

§ 371 (c)(1),
(2), (4) Date: Sep. 23, 2010

(87) PCT Pub. No.: WO2009/128136

PCT Pub. Date: Oct. 22, 2009

(65) Prior Publication Data

US 2011/0010899 A1 Jan. 20, 2011

(51) Int. Cl.
*A44B 19/02* (2006.01)

(52) U.S. Cl.
USPC ..... 24/411; 24/403; 24/409

(58) Field of Classification Search ..... 24/403, 24/409, 410, 411, 412
See application file for complete search history.

(56) References Cited

U.S. PATENT DOCUMENTS 1,761,385 A * 6/1930 Cobb ..... 24/411
1,817,842 A * 8/1931 Poux et al. ..... 24/411
2,029,585 A * 2/1936 Prentice ..... 24/411
2,045,884 A * 6/1936 Sundback ..... 29/410
2,047,925 A * 7/1936 Corner ..... 24/414
2,063,515 A * 12/1936 Morin ..... 205/149
2,068,354 A * 1/1937 Seaver ..... 24/411
2,091,617 A * 8/1937 Sundback ..... 156/66
2,110,740 A * 3/1938 Seaver ..... 24/411
2,233,305 A * 2/1941 Burgeni ..... 24/405
2,239,803 A * 4/1941 Winterhalter ..... 24/411
2,268,571 A * 1/1942 Corner ..... 264/342 R
2,270,985 A * 1/1942 Winterhalter ..... 24/413
2,312,494 A * 3/1943 Soave ..... 24/411
2,335,668 A * 11/1943 Hamm ..... 24/405
2,361,782 A * 10/1944 Low ..... 24/411
2,382,261 A * 8/1945 Scher ..... 24/411
2,628,400 A * 2/1953 Firing ..... 24/411
2,727,290 A * 12/1955 Planas ..... 24/411
3,187,540 A * 6/1965 Macbroom ..... 72/197
3,302,259 A * 2/1967 Waldes ..... 24/411

(Continued)

FOREIGN PATENT DOCUMENTS

EP 0064764 A2 11/1983
EP 0175198 A2 3/1986
JP 58-116946 A 7/1983
JP 1-22505 Y2 7/1989

OTHER PUBLICATIONS

Put International Search Report, PCT Application No. PCT/JP2008/057303, mailed May 13, 2008.

*Primary Examiner* — Robert J Sandy
*Assistant Examiner* — Abigail E Morrell
(74) *Attorney, Agent, or Firm* — Kilpatrick Townsend & Stockton LLP

(57) ABSTRACT

Metallic one-side teeth include an upper inclined plane declining toward the side of interlock dent portion provided between the opening edge of the interlock dent portion and the apical edge of an interlock head portion.

9 Claims, 6 Drawing Sheets

U.S. PATENT DOCUMENTS 3,622,936 A * 11/1971 Negishi ..... 439/285
3,735,454 A * 5/1973 Goldstein ..... 24/414
4,004,327 A * 1/1977 Fukuroi et al. ..... 24/411
4,236,284 A * 12/1980 Kamiya ..... 24/411
4,236,683 A * 12/1980 Moertel ..... 24/411
4,432,126 A * 2/1984 Sugahara ..... 29/410
4,651,388 A * 3/1987 Horikawa et al. ..... 24/409
5,394,593 A * 3/1995 Aoki ..... 24/411
6,453,521 B1 * 9/2002 Dischler ..... 24/406
6,913,835 B2 * 7/2005 Aoki et al. ..... 428/577
7,082,649 B2 * 8/2006 Aoki et al. ..... 24/414
7,665,193 B2 * 2/2010 Hasegawa et al. ..... 24/410
8,015,674 B2 * 9/2011 Matsui et al. ..... 24/413
2008/0209695 A1 * 9/2008 Matsui et al. ..... 24/412

* cited by examiner

METALLIC ONE-SIDE TEETH AND TWO-WAY SLIDE FASTENER

This application is a national stage application of PCT/JP2008/057303, which is incorporated herein by reference.

TECHNICAL FIELD

The present invention relates to a metallic one-side tooth that has an interlock convex portion and an interlock dent portion formed on both surfaces of an interlock head portion, and a two-way slide fastener including the metallic one-side tooth.

BACKGROUND ART

In an opening of a bag, a slide fastener is widely used to open and close the bag. As a type of this slide fastener, a two-way slide fastener where two sliders are disposed in a fastener chain to face each other with head alignment or tail alignment is known. In the two-way slide fastener, even though the two sliders are slid in either a forward direction or a backward direction along element rows, the fastener chain can be opened and closed.

As teeth that are attached to the two-way slide fastener, the metallic one-side teeth are used. If the metallic one-side teeth are used, a two-way slide fastener that is strong in rigidity against horizontal pull force, has a metal glossy surface, and is excellent in design can be obtained. As a shape of the metallic one-side tooth, an interlock convex portion is formed on one surface of an interlock head portion and an interlock dent portion is formed on the other surface.

Meanwhile, in a two-way slide fastener that uses general metallic one-side teeth, when one slider is slid and the metallic one-side teeth are interlocked or the interlocked metallic one-side teeth are released from an interlock state, sliding movement resistance is small and the sliding movement of the slider can be smoothly performed. For example, when the other slider is slid and the metallic one-side teeth are released from the interlock state, even though sliding movement resistance becomes slightly higher than sliding movement resistance at the time of sliding movement in one slider, the interlocked metallic one-way teeth can be smoothly released.

However, when the metallic one-side teeth are interlocked by the other slider, the sliding movement resistance increases and the slide fastener cannot be smoothly opened and closed.

This reason is considered as follows. When the metallic one-side teeth are interlocked, the metallic one-side teeth are interlocked while an outside edge of an interlock dent portion comes into colliding contact with an interlock head portion of the interlocked counterpart-side tooth. For this reason, the sliding movement of the slider is not smoothly performed.

In order to prevent the outside edge of the interlock dent portion and the interlock head portion of the interlocked counterpart-side tooth from coming into colliding contact with each other, shapes of the metallic one-side teeth are variously suggested. As an example of the metallic one-side teeth, the present applicant already suggests metallic one-side teeth that are formed by a forming apparatus of teeth for a slide fastener (refer to Patent Document 1) or teeth for a slide fastener (refer to Patent Document 2).

The metallic one-side teeth that are described in Patent Document 2 are metallic one-side teeth that are obtained by improving the metallic one-side teeth formed by the forming apparatus described in Patent Document 1. In drawings of Patent Document 2, the configuration of a feature portion of the metallic one-side teeth described in Patent Document 1 is also shown. The configuration of the feature portion of the metallic one-side teeth that can be formed by the forming apparatus described in Patent Document 1 will be described using a cross-sectional view and a perspective view of the metallic one-side teeth described in Patent Document 2.

FIG. 5 is a cross-sectional view showing an interlock head portion of the metallic one-side tooth described in Patent Document 2 and FIG. 6 is a main portion perspective view showing the interlock head portion of the metallic one-side tooth described in Patent Document 2. In the metallic one-side tooth described in Patent Document 1, an inclined plane 37 is formed in a front end wall of an interlock head portion 33 at the side of an interlock dent portion 35.

FIGS. 5 and 6 illustrate a second conventional example of the invention.

First, the case where two interlock head portions 33*b* and 33*c* are interlocked will be described using FIG. 5. FIG. 5 shows a state where the interlock head portion 33*b* is beginning to interlock with the interlock head portion 33*a* which is already interlocked with the other metallic one-side tooth, and the interlock head portion 33*c* is about to interlock with the interlock head portion 33*b*.

When a slider (not shown in the drawings) is slid and the two interlock head portions 33*b* and 33*c* are interlocked with each other, an inclined plane 37*b* is formed in a front end wall 36*b* of the interlock head portion 33*b* to prevent an interlock head portion 34*c* to be interlocked and the front end wall 36*b* of the interlocked interlock head portion 33*b* from being interlocked while coming into sliding contact with each other. Likewise, in the interlock head portions 33*a* and 33*c*, inclined planes 37*a* and 37*c* are formed in front end walls 36*a* and 36*c* of the interlock head portions 33*a* and 33*c* to prevent the front end walls from coming into colliding contact with counterpart-side interlock convex portions performing interlocking.

FIG. 5 shows a state where an interlock convex portion 34*b* formed in the interlock head portion 33*b* passes through a region of the inclined plane 37*a* formed in the front end wall 36*a* of the interlock head portion 33*a* and is inserted into the interlock dent portion 35*a*.

As shown in FIG. 6, if the inclined plane 37 is formed in the front end wall 36 of the interlock head portion 33, sliding movement resistance of the slider at the time of interlocking can be decreased and sliding movement of the slider can be smoothly performed. If the metallic one-side teeth that are formed by the apparatus described in Patent Document 1 are used in a two-way slide fastener, slidability of the slider when the metallic one-side teeth are interlocked can be improved.

However, even in the case where the metallic one-side teeth that are formed by the apparatus described in Patent Document 1 are used in a two-way slide fastener, when horizontal pull force is applied to the two-way slide fastener after interlocking, the horizontal pull force is applied to an opening edge 39 in the interlock dent portion 35 of the metallic one-side tooth shown in FIG. 6. Since the inclined plane 37*c* is formed in the front end wall 36 of the interlock head portion 33, the thickness of the opening edge 39 of the interlock dent portion 35 is configured to be small.

For this reason, if moment based on the horizontal pull force is applied to the opening edge 39 of the interlock dent portion 35 where the thickness decreases, the bending amount in the opening edge 39 may increase. If the opening edge 39 is greatly bent, slidability of the slider may be deteriorated.

The metallic one-side tooth that is described in Patent Document 2 is a metallic one-side tooth that is obtained by improving the metallic one-side tooth, such that the bending amount in the opening edge 39 decreases, even when the moment based on the horizontal pull force is applied to the opening edge 39 of the interlock dent portion 35. In the metallic one-side tooth that is described in Patent Document 2, as shown in FIG. 6, a rib 38 is formed on an inner side of the front end wall 36 of the interlock head portion 33.

By the rib 38 formed on the inner side of the front end wall 36 of the interlock head portion 33, rigidity in the opening edge 39 is enhanced. If the rigidity in the opening edge 39 is enhanced, the bending amount in the opening edge 39 decreases. If the bending amount in the opening edge 39 is decreased, slidability of the slider can be greatly improved.

Patent Document 1: Japanese Patent Application Laid-Open (JP-A) No. 58-116946

Patent Document 2: Japanese Utility Model Application Publication (JP-Y) No. 1-22505

DISCLOSURE OF THE INVENTION

Problems to be Solved by the Invention

The metallic one-side tooth that is described in Patent Document 2 is a metallic one-side tooth that is obtained by improving the metallic one-side tooth that is described in Patent Document 1, and the slidability of the slider can be greatly improved. The tooth is configured by enhancing rigidity against the moment based on the horizontal pull force. In order to form the metallic one-side tooth that is described in Patent Document 2, it is needed to form the rib 38 in the interlock dent portion 35 and then form the inclined plane 37*c* in the front end wall 36 of the interlock head portion 33. For this reason, forming needs to be performed using a complicated mold shape, and a process for manufacturing the metallic one-side tooth may become complicated.

Accordingly, it is an object of the invention to provide a metallic one-side tooth that can prevent a colliding contact at the time of interlocking, can enhance rigidity against moment based on horizontal pull force, and can be configured with a simple structure, and a two-way slide fastener using the metallic one-side tooth.

Means for Solving the Problems

In order to achieve the above object, a metallic one-side tooth according to the invention is a one-side tooth that has an interlock convex portion formed on one side of an interlock head portion and an interlock dent portion formed on the other side, a downward inclined upper inclined plane is formed toward an inner portion of the interlock dent portion from the side of an apical edge of the interlock head portion, and an inner circumferential surface of the interlock dent portion at the side of the apical edge of the interlock head portion and the upper inclined plane are configured to be joined to each other.

In the metallic one-side tooth according to the invention, the upper inclined plane is formed between the apical edge of the interlock head portion and an opening edge of the interlock dent portion.

Additionally, in the metallic one-side tooth according to the invention, the apical edge of the interlock head portion and an end edge of the upper inclined plane at the side of the apical edge are disposed to be separated from each other.

Also, in the metallic one-side tooth according to the invention, the inner circumferential surface of the interlock dent portion that is joined to the upper inclined plane is formed as a lower inclined plane that extends outward from a bottom surface of the interlock dent portion, and the upper inclined plane is configured to have an inclined angle less than an inclined angle of the lower inclined plane.

In the metallic one-side tooth according to the invention, the inclined angle of the upper inclined plane is more than 0 degree and equal to or less than 7 degrees.

Additionally, in the metallic one-side tooth according to the invention, the inclined angle of the upper inclined plane is equal to or more than 3 degrees and equal to or less than 7 degrees.

Also, in the metallic one-side tooth according to the invention, a horizontal width dimension of the upper inclined plane in a horizontal direction is configured in a dimension range of 89% to 92% of a horizontal width dimension of the bottom surface of the interlock dent portion in a horizontal direction.

A two-way slide fastener according to the invention includes fastener stringers as a central feature where the metallic one-side teeth are disposed at a predetermined interval, in facing side edges of a pair of left and right fastener tapes.

Effect of the Invention

In the metallic one-side tooth according to the invention, the downward inclined upper inclined plane is formed toward an inner portion of the interlock dent portion. For this reason, the counterpart-side interlock convex portion that is interlocked with the interlock dent portion passes the side of the upper inclined plane that is formed in the interlock dent portion, and can draw a trajectory of the counterpart-side interlock convex portion being inserted into the interlock dent portion. The counterpart-side interlock head portion passes the side of the upper inclined plane of the interlocked interlock dent portion and a gap for avoiding a colliding contact can be provided between the subsequently interlocked interlock convex portion and the counterpart-side interlock head portion. Accordingly, the interlock convex portion can be smoothly interlocked with the interlocked counterpart-side interlock dent portion.

In the metallic one-side teeth that are described in Patent Documents 1 and 2, as shown in FIG. 5, the interlock convex portion 34*b* of the interlock head portion 33*b* passes the side of the inclined plane 37*a* that is formed in the interlock head portion 33*a*, and is interlocked with the interlock dent portion 35*a* while drawing a trajectory of the interlock convex portion 34*b* being inserted into the interlock dent portion 35*a* of the interlock head portion 33*a*. Likewise, the interlock convex portion 34*c* of the interlock head portion 33*c* passes the side of the inclined plane 37*b* that is formed in the interlock head portion 33*b*, and is interlocked with the interlock dent portion 35*b* while drawing a trajectory of the interlock convex portion 34*c* being inserted into the interlock dent portion 35*b* of the interlock head portion 33*b*.

As such, in the metallic one-side teeth that are described in Patent Documents 1 and 2, the interlock convex portion passes the side of the inclined plane and the gap for avoiding a colliding contact is provided between the subsequently interlock convex portion and the interlock convex portion. Meanwhile, in the metallic one-side teeth according to the invention, the interlock convex portion passes the side of the upper inclined plane that is formed in the interlock dent portion of the interlock destination, and can avoid a colliding contact with the interlock convex portion of the subsequently interlocked interlock head portion while avoiding a colliding contact of the interlock convex portion and the interlock dent portion of the interlock destination.

When the metallic one-side teeth according to the invention are used in the two-way slide fastener, if the horizontal pull force is applied to the two-way slide fastener after interlocking, the moment based on the pressing force from the interlocked counterpart-side interlock convex portion is applied to the opening edge of the interlock dent portion. That is, the moment based on the horizontal pull force is greatly applied to the joining portion of the inner circumferential surface of the interlock dent portion at the apical edge side of the interlock head portion of the metallic one-side tooth and the upper inclined plane.

However, in the invention, since the thickness of the opening edge of the interlock dent portion is configured to be large, even though the moment based on the horizontal pull force is applied to the opening edge of the interlock dent portion, the bending amount in the opening edge of the interlock dent portion becomes extremely small. As such, the deformation that deteriorates slidability of the slider is not generated at the side of the apical edge of the interlock head portion, and superior slidability of the slider can be maintained.

In the invention, since the upper inclined plane is formed between the apical edge of the interlock head portion and the opening edge of the interlock dent portion, the colliding contact of the counterpart-side interlock convex portion and the interlock head portion can be decreased and slidability of the slider can be greatly improved.

Additionally, in the invention, since the apical edge of the interlock head portion and the end edge of the upper inclined plane at the side of the apical edge are disposed to be separated from each other, the thickness of the opening edge of the interlock dent portion can be further increased. Accordingly, even though the moment based on the horizontal pull force is applied to the opening edge of the interlock dent portion, the bending amount in the opening edge of the interlock dent portion can be further decreased.

In the invention, since the lower inclined plane is formed on the inner circumferential surface of the interlock dent portion, the interlocked counterpart-side interlock convex portion can be easily received in the interlock dent portion, and the interlocked counterpart-side interlock convex portion can be easily separated from the interlock dent portion.

Since the inclination angle of the upper inclined plane is configured to be less than the inclination angle of the lower inclined plane, the contact area of the interlock convex portion and the lower inclined plane of the interlock dent portion can be increased, and the interlock state at the time of interlocking can be securely maintained.

As such, since the thickness of the opening edge of the interlock dent portion can be configured to be large, rigidity in the opening edge of the interlock dent portion can be further enhanced. The contact area of the counterpart-side interlock convex portion and the lower inclined plane of the interlock dent portion can be increased.

That is, the position of the center of gravity of the interlock convex portion at the side of the surface on which the interlocked interlock convex portion comes into contact with the lower inclined plane of the interlock destination can be made to be closer to the side of the bottom surface in the interlock dent portion of the interlock destination than the opening edge of the lower inclined plane. In other words, the interlock convex portion can be interlocked with the interlock dent portion of the interlock destination in a state where the waist portion is more lowered than the opening edge of the lower inclined plane.

Accordingly, even though the horizontal pull force is applied and rotation moment based on the opening edge of the interlock dent portion is applied to the interlocked counterpart-side interlock convex portion, the interlocked counterpart-side interlock convex portion can be prevented from rotating on the basis of the opening edge in the interlock dent portion of the interlock destination, and the interlock state can be prevented from being released.

In the invention, the inclined angle of the upper inclined plane is preferably more than 0 degree and equal to or less than 7 degrees. More preferably, the inclined angle of the upper inclined plane is equal to or more than 3 degrees and equal to or less than 7 degrees. If the inclination angle of the upper inclined plane is configured in the angle range, the contact area of the interlock convex portion and the lower inclined plane of the interlock dent portion can be configured as an area where the interlock strength as the slide fastener can be maintained.

If the inclination angle of the upper inclined plane is configured to be more than 7 degrees, the contact area between the interlock convex portion and the lower inclined plane of the interlock dent portion of the interlock destination is narrowed and the interlock strength against the horizontal pull force may become weak. In this case, in the interlocked interlock convex portion, the position of the center of gravity of the interlock convex portion at the side of the surface on which the interlocked interlock convex portion comes into contact with the lower inclined plane of the interlock destination may become close to the side of the opening edge of the lower inclined plane in the interlock dent portion of the interlock destination or may become the upper side of the opening edge of the lower inclined plane.

That is, the interlock convex portion may be interlocked with the interlock dent portion of the interlock destination, in a waist raised state with respect to the opening edge of the lower inclined plane.

As such, if the interlocked interlock convex portion is interlocked with the interlock dent portion of the interlock destination in the waist raised state, when the horizontal pull force is applied, the interlock state may be easily released.

In the metallic one-side tooth according to the invention, when the horizontal width dimension of the upper inclined plane in a horizontal direction is configured to be more than 92% of a horizontal width dimension of the bottom surface of the interlock dent portion in a horizontal direction, the horizontal width of the upper inclined plane is configured to be large, and the thickness of the upper side in the front end wall of the interlock head portion may be decreased. As a result, the strength of the interlock dent portion is insufficient, and the strength against the horizontal pull force may be lowered.

When the horizontal width dimension of the upper inclined plane in a horizontal direction is configured to be less than 89% of a horizontal width dimension of the bottom surface of the interlock dent portion in a horizontal direction, the horizontal width of the upper inclined plane is configured to be small, the colliding contact area of the portions of both side end sides of the upper inclined plane in the interlock head portion and the interlock convex portion increases, and slidability of the slider may be deteriorated.

Accordingly, the horizontal width dimension of the upper inclined plane in a horizontal direction is preferably configured in a dimension range of 89% to 92% of a horizontal width dimension of the bottom surface of the interlock dent portion in a horizontal direction, because superior slidability of the slider can be maintained and the strength of the front end wall of the interlock head portion can be maintained.

Further, a two-way slide fastener can be manufactured using the metallic one-side teeth according to the invention. By this configuration, the slidability of the two sliders can be greatly improved, and a two-way slide fastener where the interlock state is not released by the horizontal pull force can be configured.

EXPLANATION OF LETTERS OR NUMERALS

Figure 1:
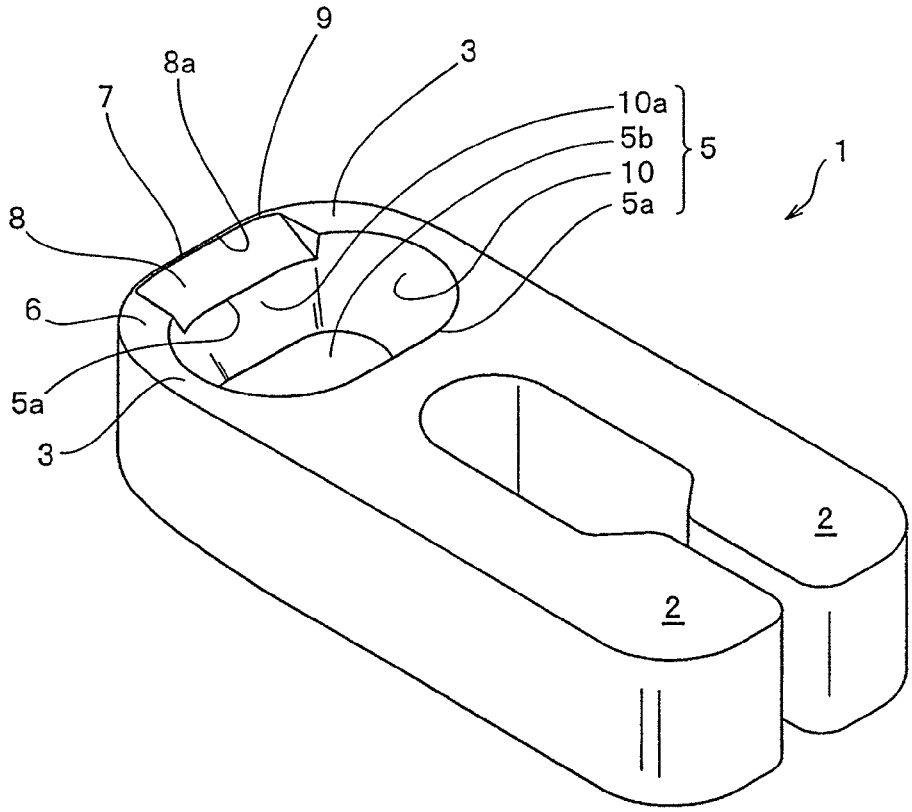
FIG. 1 is a perspective view of a metallic one-side tooth according to the invention.

1: metallic one-side tooth
3: interlock head portion
4: interlock convex portion
5: interlock dent portion
5*a*: opening edge
7: apical edge
8: upper inclined plane
10*a*: lower inclined plane
12: two-way slide fastener
14: first slider
15: second slider
33 (33*a*, 33*b*, 33*c*): interlock head portion
34 (34*a*, 34*b*, 34*c*): interlock convex portion
35 (35*a*, 35*b*, 35*c*): interlock dent portion
36 (36*a*, 36*b*, 36*c*): front end wall
37 (37*a*, 37*b*, 37*c*): inclined plane
38: rib
39 (39*a*, 39*b*, 39*c*): opening edge

BEST MODE FOR CARRYING OUT THE INVENTION

Hereinafter, a best mode to carry out the invention will be described in detail with reference to the drawings. The invention is not limited to an embodiment to be described below, and various changes can be made as long as substantially the same configuration and the same function and effect as the invention are implemented.

EXAMPLE

Figure 2:
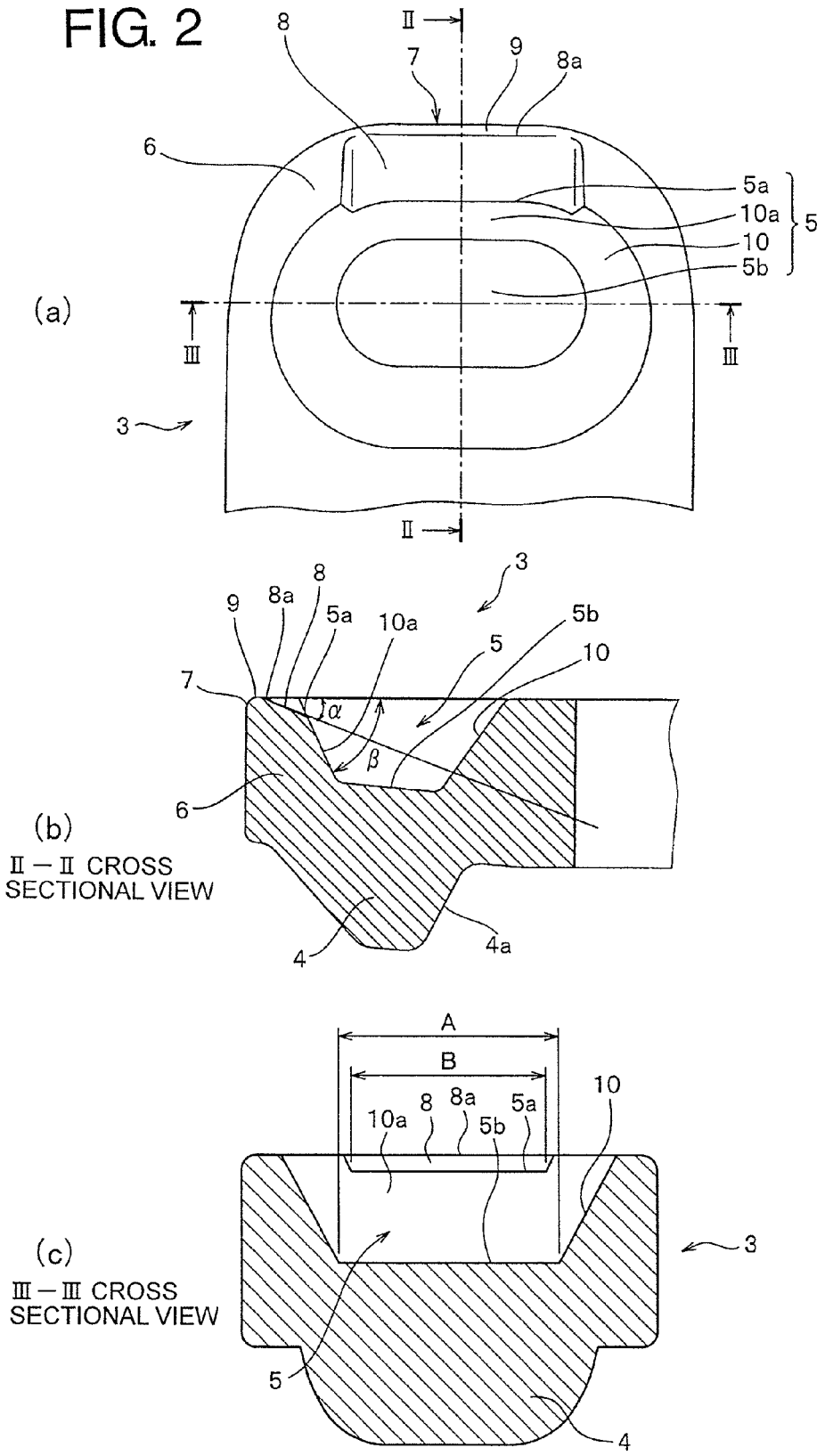
FIG. 2, comprising FIGS. 2(*a*), 2(*b*) and 2(*c*), is a plan view of an interlock head portion, a cross-sectional view taken along the line II-II of the interlock head portion, and a cross-sectional view taken along the line III-III.
Figure 3:
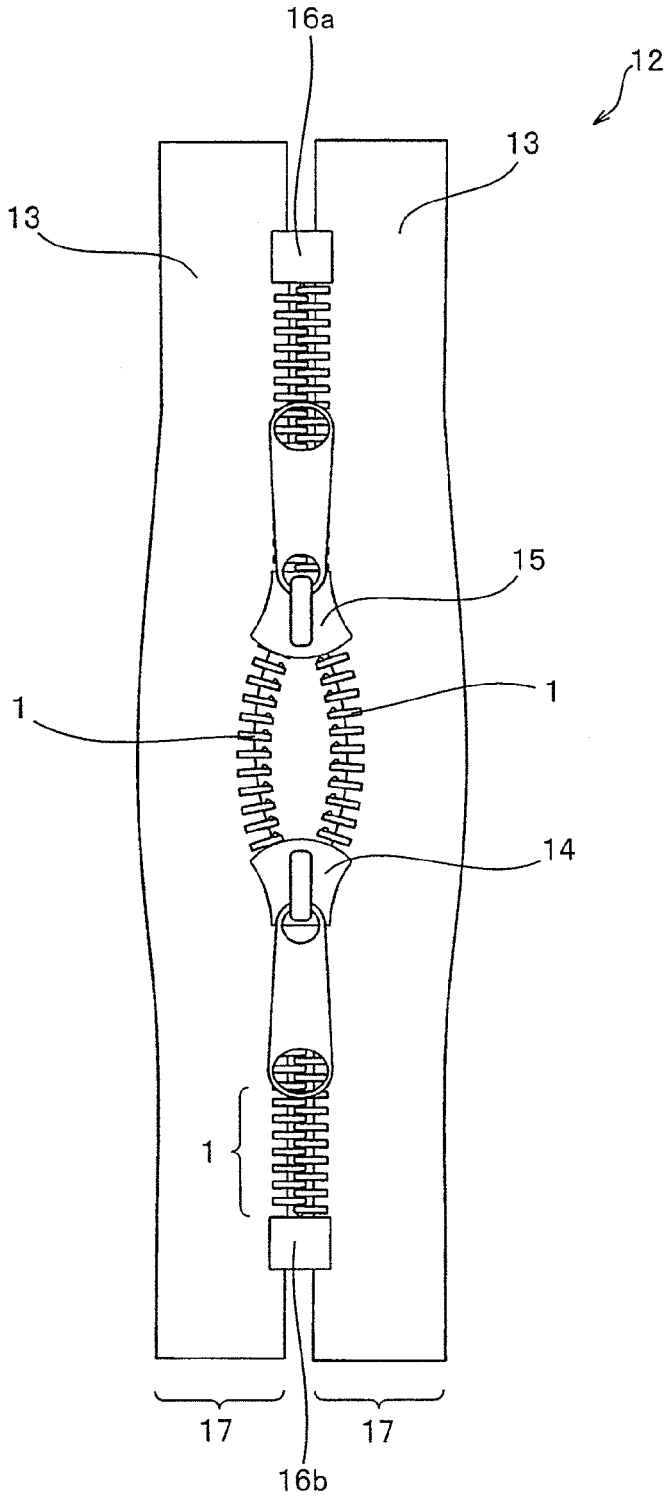
FIG. 3 is a plan view of a two-way slide fastener.
Figure 4:
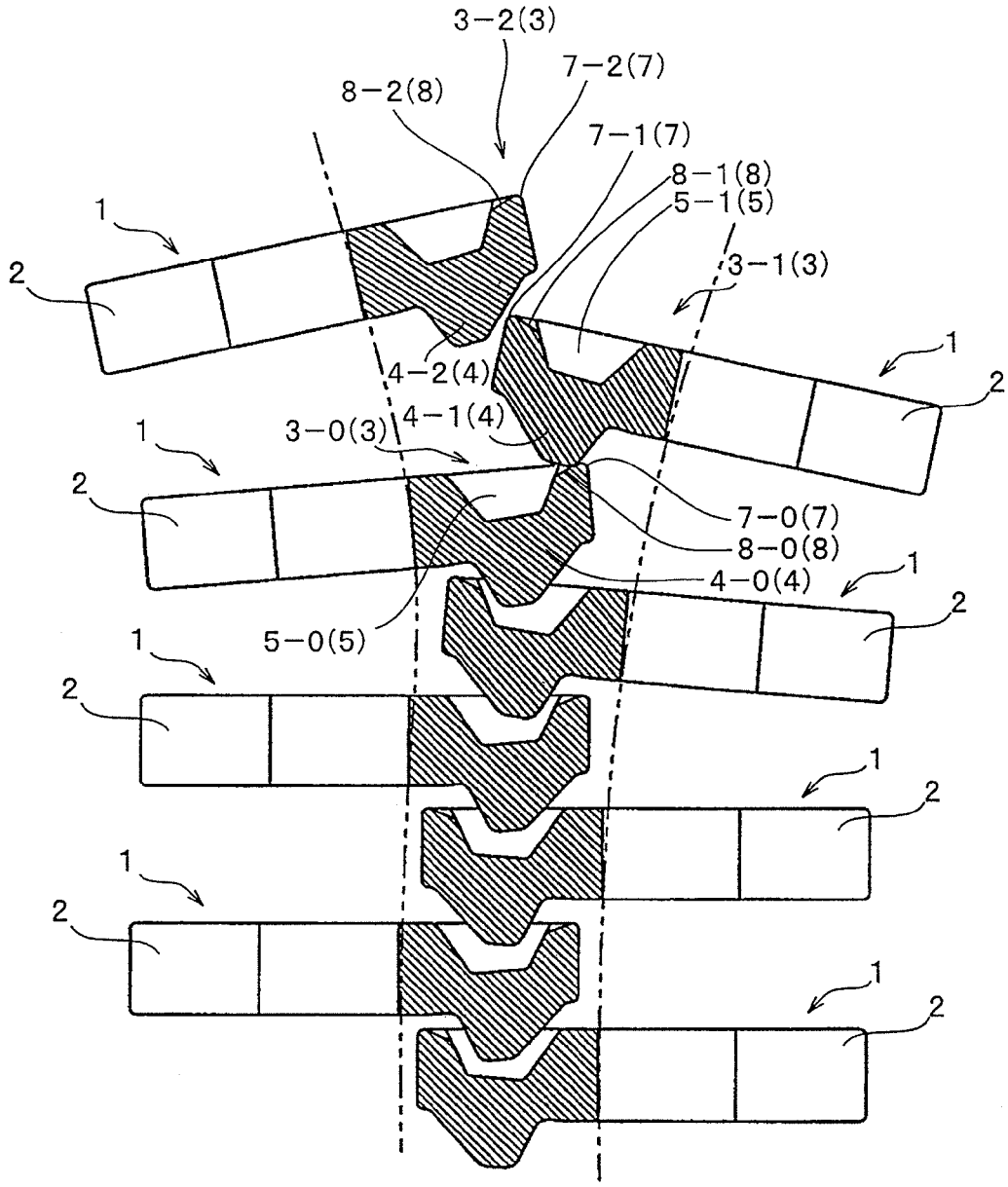
FIG. 4 is a main portion cross-sectional view showing an interlock situation of the metallic one-side tooth.
Figure 5:
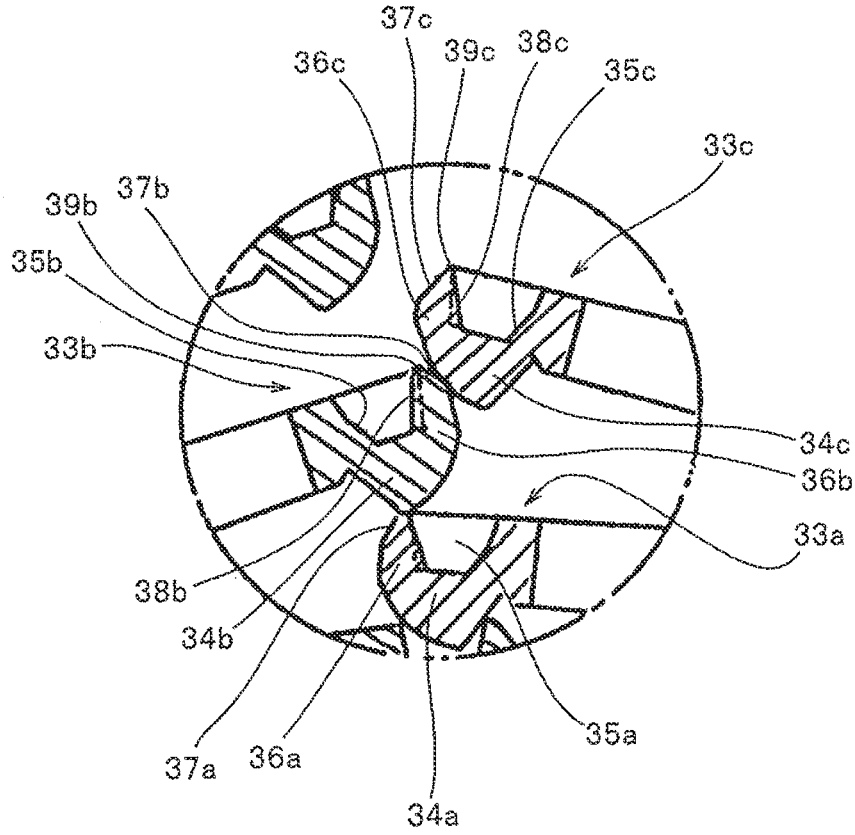
FIG. 5 PRIOR ART
FIG. 5 is a main portion cross-sectional view showing an interlock situation of a metallic one-side tooth according to a second conventional example.
Figure 6:
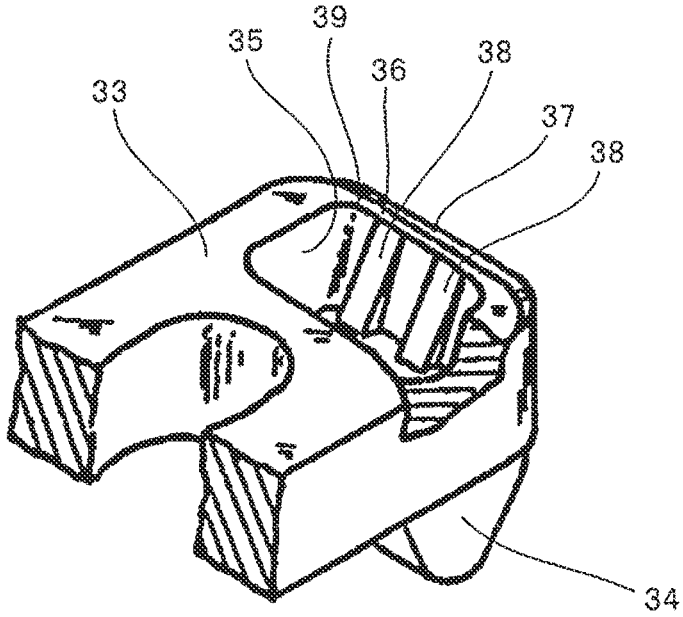
FIG. 6 PRIOR ART
FIG. 6 is a perspective view showing the metallic one-side tooth according to the second conventional example.

FIG. 1 is a perspective view of a metallic one-side tooth according to this embodiment. FIG. 2(*a*) is a plan view of an interlock head portion and FIG. 2(*b*) is a cross-sectional view taken along the line II-II in FIG. 2(*a*). FIG. 2(*c*) is a cross-sectional view taken along the line in FIG. 2(*a*). FIG. 3 is a plan view of a two-way slide fastener using the metallic one-side tooth according to this embodiment and FIG. 4 is a main portion cross-sectional view showing an interlock situation of the metallic one-side tooth.

In the invention, an anteroposterior direction of the metallic one-side tooth means a direction that becomes a tape width direction when the metallic one-side tooth is attached to a fastener tape, and a horizontal direction and a vertical direction of the metallic one-side tooth mean directions that become a tape front/back direction and a tape longitudinal direction when the metallic one-side tooth is attached to the fastener tape, respectively.

A metallic one-side tooth 1 according to this embodiment that is shown in FIG. 1 can be continuously manufactured by cutting a metallic wire rod called a Y bar at the predetermined thickness and performing press working on an interlock head portion 3 of the tooth from a vertical direction after the cutting. Alternatively, the metallic one-side tooth 1 according to this embodiment that is shown in FIG. 1 can be continuously manufactured by performing press working on a metal plate at least once and punching the metal plate subjected to the press working in an outer circumferential shape of the metallic one-side tooth 1.

By the press working described above, an interlock convex portion 4 can be formed on one surface of the interlock head portion 3 in a vertical direction, and an interlock dent portion 5 and an upper inclined plane 8 can be formed on the other surface. As will be described below, a lower inclined plane 10*a* and an upper inclined plane 8 of an inner circumferential surface 10 of the interlock dent portion 5 that are surfaces at the side of an apical edge of the interlock head portion 3 are formed in simple shapes to be joined. By this configuration, even though plural molds for the press working are not prepared, the interlock dent portion 5 and the upper inclined plane 8 can be formed by at least one-time press working.

As shown in FIGS. 1 and 2, a pair of left and right legs 2 are formed at the rear side of the metallic one-side tooth 1. In the interlock head portion 3 at the front side of the metallic one-side tooth 1, an interlock convex portion 4 (refer to FIGS. 2(*b*) and 2(*c*)) is formed on one side of the metallic one-side tooth 1 in a vertical direction and the interlock dent portion 5 is formed on the other side.

The downward inclined upper inclined plane 8 is formed toward an inner portion of the interlock dent portion 5 from the side of the apical edge 7 of the front side of the interlock head portion 3 at the other side of the metallic one-side tooth 1. The upper inclined plane 8 can be formed by performing the press working as described above. However, the upper inclined plane 8 may be formed on the side of the apical edge 7 of the interlock head portion 3 by performing cutting working or grinding working, without performing the press working. However, when the upper inclined plane 8 is formed by the press working, working hardening can be generated by plastic deformation of when the upper inclined plane 8 is formed. Therefore, rigidity of the upper inclined plane 8 can be enhanced.

As shown in FIGS. 2(*a*) to 2(*c*), the inner circumferential surface 10 of the interlock dent portion 5 has a cone shape and is configured to extend outward from a bottom surface 5*b* of the interlock dent portion 5. Of the inner circumferential surface 10 of the interlock dent portion 5, the lower inclined plane 10*a* of the interlock head portion 3 at the side of the apical edge 7 is joined to the upper inclined plane 8 and the opening edge 5*a* of the interlock dent portion 5.

As shown in FIG. 2(*b*), as an inclination angle $\alpha$ of the upper inclined plane 8, an angle that is more than 0 degree and equal to or less than 7 degrees can be set. Preferably, the inclination angle $\alpha$ of the upper inclined plane 8 is set to an angle equal to or more than 3 degrees or equal to or less than 7 degrees. Further, since the inclination angle $\alpha$ of the upper inclined plane 8 is set to be less than an inclination angle $\beta$ of the lower inclined plane 10*a*, an angle that is equal to or more than 20 degrees or equal to or less than 30 degrees is preferably set as the inclination angle $\beta$ of the lower inclined plane 10*a*.

If the inclination angle $\beta$ of the lower inclined plane 10*a* is configured in an angle range of 20 degrees to 30 degrees, when horizontal pull force is applied to the interlocked two-way slide fastener 1 shown in FIG. 3, in the lower inclined plane 10*a*, a portion of the horizontal pull force can be released to the upper side, and the remaining horizontal pull force can be received by the lower inclined plane 10*a*.

As shown in FIG. 2(*c*), a dimension of the horizontal width B in the upper inclined plane 8 can be configured to become 89% to 92% of a dimension of the horizontal width A in the bottom surface 5*b* of the interlock dent portion 5. When the dimension of the horizontal width A in the bottom surface 5*b* is configured to become a dimension more than 92% of the dimension of the horizontal width B of the upper inclined plane 8, the horizontal width B of the upper inclined plane 8 is configured to be large. For this reason, the thickness of the upper side in the front end wall 6 of the interlock head portion 3 decreases, strength of the interlock dent portion 5 is insufficient, and strength against the horizontal pull force may be lowered.

When the dimension of the horizontal width A of the bottom surface 5*b* is configured to become a dimension less than 89% of the dimension of the horizontal width B of the upper inclined plane 8, the horizontal width B of the upper inclined plane 8 is configured to be small. For this reason, a colliding contact area of portions of both side end sides of the upper inclined plane 8 in the interlock head portion 3 and the interlock convex portion 4 may increase, and slidability of the slider may be deteriorated.

By this configuration, when the horizontal pull force is applied to the two-way slide fastener 1 shown in FIG. 3, a contact area of a counterpart-side interlock convex portion 4 interlocked with the interlock dent portion 5 and the interlock dent portion 5 can be increased. By this configuration, when the horizontal pull force is applied, the counterpart-side interlock convex portion 4 can be prevented from being released from an interlock state with the interlock dent portion 5, and the horizontal pull force can be received by the contact area of the counterpart-side interlock convex portion 4 and the interlock dent portion 5.

If the contact area of the counterpart-side interlock convex portion 4 and the interlock dent portion 5 is configured to be large, tension stress per unit area with respect to the horizontal pull force can be decreased. Further, the thickness of the front end wall 6 in the opening edge 5*a* of the interlock dent portion 5 can be increased and rigidity of the opening edge 5*a* of the interlock dent portion 5 can be enhanced.

Additionally, even when the horizontal pull force is applied and rotation moment based on the opening edge 5*a* of the interlock dent portion 5 is applied to the counterpart-side interlock convex portion 4 interlocked with the interlock dent portion 5, a contact area of the counterpart-side interlock convex portion 4 and the lower inclined plane 10*a* of the interlock dent portion 5 can be increased. Thereby, the interlocked counterpart-side interlock convex portion 4 can be prevented from rotating in a direction separated on the basis of the opening edge 10*a* of the interlock dent portion 5, and the interlock state can be prevented from being released.

The interlock convex portion 4 that is formed in the interlock head portion 3 comes into contact with the lower inclined plane 10*a* of the interlocked counterpart-side interlock dent portion 5, when the horizontal pull force is applied. At this time, in order to increase a contact area of the inclined plane 4*a* of the interlock convex portion 4 coming into contact with the counterpart-side lower inclined plane 10 and the counterpart-side lower inclined plane 10*a*, the inclination angle of the inclined plane 4*a* of the interlock convex portion 4 and the inclination angle of the lower inclined plane 10*a* can be configured to become almost the same angle, with respect to an axis of the vertical direction of the metallic one-side tooth 1.

If the inclination angle α of the upper inclined plane 8 shown in FIG. 2(*b*) is configured to become an angle more than 7 degrees described above, when the horizontal pull force is applied, a contact area of the counterpart-side interlock convex portion 4 that comes into contact with the lower inclined plane 10*a* may be decreased. For this reason, rotation momentum of a direction releasing the interlock state based on the opening edge 5*a* of the upper inclined plane 8 and the lower inclined plane 10*a*, of the opening edge corresponding to a boundary of a top surface of the interlock head portion 3 and the interlock dent portion 5, is easily applied to the counterpart-side interlock head portion 3, and a rotation based on the opening edge 5*a* of the interlock dent portion 5 is easily generated. As a result, the interlock state may be easily released.

As shown in FIGS. 1, 2(*a*), and 2(*b*), the apical edge 7 of the interlock head portion 3 and an end edge 8*a* of the upper inclined plane 8 at the side of the apical edge 7 are configured to be separated from each other. In the example shown in the drawings, the separate portion is shown as a flat surface 9. However, the separated portion can be configured in a rounded shape, like a curved surface shape of a portion of a cylindrical surface. If the separated portion is provided, the thickness of the front end wall 6 in the opening edge 5*a* of the interlock dent portion 5 can be increased.

Even though the counterpart-side interlock convex portion 4 comes into colliding contact with the apical edge 7 of the interlock head portion 3 during the interlock, since the apical edge 7 of the interlock head portion 3 and the end edge 8*a* of the upper inclined plane 8 are separated from each other, the apical edge 7 of the interlock head portion 3 can be prevented from deforming due to the counterpart-side interlock convex portion 4.

FIG. 3 is a plan view of a two-way slide fastener in which the metallic one-side tooth 1 shown in FIG. 1 is attached to a core cord portion provided along a side edge of the faster tape 13. The core cord portion of the fastener tape 13 is inserted between the opened left and right legs 2 (leg shape after being swaged to the tape is shown in FIG. 1) of the metallic one-side tooth 1 shown in FIG. 1, and the left and right legs 2 are pressed from the external side using a swage punch and is swaged in a direction narrowing the leg opening width. Thereby, the fastener tape 13 is interposed and nipped between the left and right legs 2, and the metallic one-side tooth 1 can be attached to the fastener tape 13.

In this way, the plural metallic one-side teeth 1 according to the invention are put in the tape-side edges of the pair of left and right fastener tapes 13 at a predetermined interval, and left and right fastener stringers 17 can be manufactured. A first slider 14 and a second slider 15 are inserted into a tooth train of the obtained fastener stringers 17, a top stop 16*a* and a bottom stop 16*b* are attached to front and rear ends of the tooth train in a sliding movement direction, and the two-way slide fastener 12 shown in FIG. 3 can be manufactured.

In the two-way slide fastener 12 that is obtained in the above way, the interlock convex portion 4 of each metallic one-side tooth 1 can be appropriately inserted into the interlock dent portion 5 of an interlock counterpart destination by sliding and moving the first slider 14 in a direction toward the top stop 16*a* or sliding and moving the second slider 15 in a direction toward the bottom stop 16*b*. If the first slider 14 or the second slider 15 is slid in a reverse direction, the interlock state can be released.

The interlock state in the second slider 15 that is interlocked from the side of the interlock convex portion 4 will be described using FIG. 4. At the time of the interlock, an interlock convex portion 4-1 can pass a surrounding portion of an upper inclined plane 8-0 that is formed in an interlock dent portion 5-0 of an interlock counterpart destination, and can be inserted into the interlock dent portion 5-0. At the time of the interlock, an interlock head portion 3-1 can be smoothly moved to the interlock position without coming into colliding contact with an interlock convex portion 4-2 inserted into an interlock dent portion 5-1 of the interlock head portion 3-1.

Since the upper inclined plane 8 is formed between the interlock dent portion 5 and the apical edge 7, the interlock convex portion 4 that is inserted into the interlock dent portion 5 does not interfere with the interlock head portion 3 of the insertion destination and the corresponding interlock head portion 3 does not interfere with the interlock convex portion 4 inserted into the corresponding interlock dent portion 5, and closing of the two-way slide fastener 12 can be smoothly performed.

As shown in FIG. 1, even though the upper inclined plane 8 is formed, the thickness of the front end wall 6 in the opening edge 5*a* of the interlock dent portion 5 can be configured to be large, and the length of the lower inclined plane in the vertical direction can be configured to be large. Therefore, even though external force such as the horizontal pull force is received when the left and right metallic one-side teeth 1 are in an interlock state, the deformation or damage of the interlock convex portion 4 or the interlock dent portion 5 can be effectively prevented.

As a result, the two-way slide fastener 12 according to the invention can stably secure superior interlock strength.

In the two-way slide fastener 12 shown in FIG. 3, the first slider 14 and the second slider 15 are disposed to face each other with head alignment. However, in the two-way slide fastener 12 according to the invention, the first slider 14 and the second slider 15 can be disposed to face each other with tail alignment.

INDUSTRIAL APPLICABILITY

The invention can be appropriately used as an element for a slide fastener attached to an opening of a bag or clothing.

The invention claimed is:

1. A metallic one-side tooth, comprising:

an interlock convex portion formed on one side of an interlock head portion, an interlock dent portion formed on the other side of the interlock head portion, wherein the interlock dent portion is configured to receive an interlock convex portion of another metallic one-side tooth, and a pair of legs extending in parallel from a rear portion of the interlock head portion, a downward inclined upper inclined plane that extends from a front portion of the interlock head portion to an opening edge of the interlock dent portion and toward an inner portion of the interlock dent portion wherein the front portion of the interlock head portion includes an apical edge, and wherein a portion of an inner circumferential surface of the interlock dent portion is joined to the upper inclined plane at the opening edge of the interlock dent portion.

2. The metallic one-side tooth according to claim 1, wherein the apical edge of the interlock head portion and an upper end edge of the upper inclined plane at the side of the apical edge are separated from each other.

3. The metallic one-side tooth according to claim 2, wherein the inner circumferential surface of the interlock dent portion that is joined to the upper inclined plane is formed as a lower inclined plane that extends outward from a bottom surface of the interlock dent portion, and the upper inclined plane is configured to have an inclined angle less than an inclined angle of the lower inclined plane.

4. A two-way slide fastener including fastener stringers where the metallic one-side teeth of claim 2 are disposed at a predetermined interval, in facing side edges of a pair of left and right fastener tapes.

5. The metallic one-side tooth according to claim 1, wherein the inner circumferential surface of the interlock dent portion that is joined to the upper inclined plane is formed as a lower inclined plane that extends outward from a bottom surface of the interlock dent portion, and the upper inclined plane is configured to have an inclined angle less than an inclined angle of the lower inclined plane.

6. The metallic one-side tooth according to claim 5, wherein the inclined angle of the upper inclined plane is more than 0 degree and equal to or less than 7 degrees.

7. The metallic one-side tooth according to claim 6, wherein the inclined angle of the upper inclined plane is equal to or more than 3 degrees and equal to or less than 7 degrees.

8. The metallic one-side tooth according to claim 1, wherein a horizontal width dimension of the upper inclined plane in a horizontal direction is configured in a dimension range of 89% to 92% of a horizontal width dimension of the bottom surface of the interlock dent portion in a horizontal direction.

9. A two-way slide fastener including fastener stringers where the metallic one-side teeth of claim 1 are disposed at a predetermined interval, in facing side edges of a pair of left and right fastener tapes.

* * * * *

UNITED STATES PATENT AND TRADEMARK OFFICE

CERTIFICATE OF CORRECTION

PATENT NO. : 8,418,326 B2
APPLICATION NO. : 12/934266
DATED : April 16, 2013
INVENTOR(S) : Futoshi Kozato et al.

It is certified that error appears in the above-identified patent and that said Letters Patent is hereby corrected as shown below:

On Title page, item (56), under "OTHER PUBLICATIONS", in column 2, line 1, delete "Put" and insert -- PCT --, therefor.

Signed and Sealed this
Twenty-fourth Day of September, 2013

Teresa Stanek Rea
*Deputy Director of the United States Patent and Trademark Office*